US009171472B2

(12) United States Patent
Scheu et al.

(10) Patent No.: US 9,171,472 B2
(45) Date of Patent: Oct. 27, 2015

(54) SYSTEM AND METHOD FOR DISPLAYING SYMBOLOGY ON AN IN-TRAIL PROCEDURE DISPLAY GRAPHICALLY AND TEXTUALLY REPRESENTATIVE OF A VERTICAL TRAFFIC SCENARIO AND AIR-TRAFFIC-CONTROL NEGOTIATION

(71) Applicant: HONEYWELL INTERNATIONAL INC., Morristown, NJ (US)

(72) Inventors: Steven Scott Scheu, Phoenix, AZ (US); Vicki Judy, Cave Creek, AZ (US); Norman R. Bernstein, Surprise, AZ (US); Emmanuel Letsu-Dake, Shakopee, MN (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 280 days.

(21) Appl. No.: 13/859,622

(22) Filed: Apr. 9, 2013

(65) Prior Publication Data

US 2014/0300495 A1 Oct. 9, 2014

(51) Int. Cl.
*G08G 5/04* (2006.01)
*G08G 5/00* (2006.01)

(52) U.S. Cl.
CPC ..... *G08G 5/0021* (2013.01); *G08G 5/0013* (2013.01); *G08G 5/0052* (2013.01); *G08G 5/0078* (2013.01); *G08G 5/0039* (2013.01)

(58) Field of Classification Search
CPC ..... G08B 5/00; G08B 5/0021; G08B 5/0043
USPC ..... 340/945, 961, 971
See application file for complete search history.

(56) References Cited

U.S. PATENT DOCUMENTS

| | | | | |
|---|---|---|---|---|
| 6,433,729 | B1 | 8/2002 | Staggs | |
| 6,473,003 | B2 | 10/2002 | Horvath et al. | |
| 6,542,810 | B2 | 4/2003 | Lai | |
| 6,799,114 | B2 | 9/2004 | Etnyre | |
| 6,963,291 | B2 | 11/2005 | Holforty et al. | |
| 7,570,178 | B1 * | 8/2009 | Whalen et al. | 340/961 |
| 8,099,201 | B1 | 1/2012 | Barber et al. | |
| 8,203,465 | B2 | 6/2012 | Shafaat et al. | |
| 8,271,152 | B2 | 9/2012 | Singer et al. | |

(Continued)

FOREIGN PATENT DOCUMENTS

| | | | |
|---|---|---|---|
| EP | 2388759 | A2 | 11/2011 |
| EP | 2447930 | A1 | 5/2012 |

(Continued)

OTHER PUBLICATIONS

EP Search Report for Application No. EP 14161373.7 dated Oct. 31, 2014.

(Continued)

*Primary Examiner* — Eric M Blount
(74) *Attorney, Agent, or Firm* — Ingrassia Fisher & Lorenz, P.C.

(57) ABSTRACT

A system and method is provided for displaying information related to an in-trail procedure (ITP) on a ITP display aboard a host aircraft. Current flight status data of the host aircraft and at least a second aircraft is obtained, and a vertical traffic scenario including at least the host aircraft ant the second aircraft is rendered on the display. A textual representation of a negotiation between ATC and the host aircraft is also rendered on the ITP display.

14 Claims, 15 Drawing Sheets

(56) References Cited

U.S. PATENT DOCUMENTS

| | | | | |
|---|---|---|---|---|
| 8,285,427 | B2 | 10/2012 | Rogers et al. | |
| 8,306,724 | B2 | 11/2012 | Price et al. | |
| 8,417,397 | B2 * | 4/2013 | Khatwa et al. | 701/14 |
| 2005/0049762 | A1 | 3/2005 | Dwyer | |
| 2008/0045198 | A1 | 2/2008 | Bhogal et al. | |
| 2010/0286900 | A1 | 11/2010 | Depape et al. | |
| 2010/0332054 | A1 | 12/2010 | Brandao et al. | |
| 2011/0066362 | A1 | 3/2011 | He | |
| 2011/0282522 | A1 | 11/2011 | Prus et al. | |
| 2011/0282568 | A1 | 11/2011 | Khatwa et al. | |
| 2012/0095623 | A1 | 4/2012 | Barral et al. | |
| 2012/0203448 | A1 | 8/2012 | Pepitone et al. | |
| 2012/0253564 | A1 | 10/2012 | Noll et al. | |
| 2013/0006511 | A1 | 1/2013 | Ramaiah et al. | |
| 2014/0210648 | A1 * | 7/2014 | Samuthirapandian et al. | 340/961 |

FOREIGN PATENT DOCUMENTS

| | | | |
|---|---|---|---|
| EP | 2541526 | A2 | 1/2013 |
| WO | 02099769 | A1 | 12/2002 |
| WO | 2011156027 | A1 | 12/2011 |

OTHER PUBLICATIONS

EP Examination Report for Application No. EP 14161373.7 dated Nov. 18, 2014.

Leone, A.: "Surveillance and Administration Broadcast Services—ADS-B Program Overview" Presented to: ADS-B Technology Forum, Feb. 8, 2011; URL: http://www.aea.net/Training/courses/ADSBForum/pdf/ADS-B%20Program%20Overview.pdf.

Stassen, H., et al.: "Multi-Purpose Cockpit Display of Traffic Information: Overview and Development of Performance Requirements" American Institute of Aeronautics and Astronautics, The MITRE Corporation, 2010, URL: http://www.mitre.org/work/tech_papers/2010/10_2768/10_2768.pdf.

Chartrand, R. C., et al.: "Operational Improvements from the In-Trail Procedure in the North Atlantic Organized Track System" American Institute of Aeronautics and Astronautics, 2008; URL: http://ntrs.nasa.gov/archive/nasa/casi.ntrs.nasa.gov/20080040180_2008039110.pdf.

* cited by examiner

SYSTEM AND METHOD FOR DISPLAYING SYMBOLOGY ON AN IN-TRAIL PROCEDURE DISPLAY GRAPHICALLY AND TEXTUALLY REPRESENTATIVE OF A VERTICAL TRAFFIC SCENARIO AND AIR-TRAFFIC-CONTROL NEGOTIATION

TECHNICAL FIELD

Embodiments of the subject matter described herein relate generally to avionics systems such as flight display systems. More particularly, embodiments of the subject matter described relate to a system and method for displaying symbology graphically and textually representative of an in-trail procedure (ITP), including the vertical traffic scenario and negotiation with air traffic control (ATC), on an ITP display.

BACKGROUND

An in-trail procedure (ITP) is a protocol followed by an aircraft that desires to change its current flight level to a new flight level by descending or climbing in front of or behind one or more potentially blocking aircraft that are flying at an intervening flight level. In accordance with the ITP, certain conditions must be satisfied before a flight crew member issues a request for clearance to proceed with the flight level change. Whether or not the conditions are satisfied depends on a number of dynamically changing factors associated with the host aircraft and other aircraft, such as the current geographic position of the aircraft, the current speed of the aircraft, the current heading of the aircraft, the desired new flight level, and the current flight level.

Currently, an ITP requires the simultaneous use of two separate and non-integrated functions; a traffic display for displaying traffic, and a data link communication system and associated and display, for negotiating the ITP with ATC. A pilot is required to repeatedly switch between the two display systems in an integrated system cockpit, thus significantly increasing the pilot's workload associated with negotiating and executing the ITP. The prior art has focused on systems and methods for presenting ITP traffic scenarios; however, there has been insufficient attention to how the negotiation with ITC can be accomplished without excessive crew interaction with an integrated flight deck.

In view of the foregoing, it would be desirable to provide a system and method for combining presentation of the traffic scenario associated with an ITP with the communication interactivity necessary for negotiating the ITP maneuver with ATC. Furthermore, other desirable features and characteristics will become apparent from the following detained description and the appended claims taken in conjunction with the accompanying drawings and this background.

BRIEF SUMMARY

It should be appreciated that this summary is provided to introduce a selection of non-limiting concepts. The embodiments disclosed herein are exemplary as are the combinations and permutations of various features of the subject matter disclosed herein. The discussion herein is limited for the sake of clarity and brevity.

In accordance with a first exemplary and non-limiting embodiment, there is provided a method for displaying information related to an in-trail procedure (ITP) on a display aboard a host aircraft. The method comprises obtaining current flight status data of the host aircraft and at least a second aircraft, and rendering on the display a vertical traffic scenario including at least the host aircraft ant the second aircraft. A vertical traffic scenario and a textual representation of a negotiation between ATC and the host aircraft is rendered on the display.

In accordance with a another exemplary and non-limiting embodiment, there is provided a flight deck display system for a host aircraft, the display system for generating symbology associated with an in-trail procedure (ITP) request including communications received from air traffic control (ATC). The display system comprises a data communications module for receiving flight status data from neighboring aircraft, an ITP display element, an air/ground data link; a user interface coupled to the ITP display, and a graphics system. A processor is coupled to the data communications module, the ITP display element, the graphics system, the user interface, and the air/ground data link. The processor is configured to (1) render on the ITP display element a vertical traffic scenario, and (2) render on the ITP display a graphical and textual representation of the ITP negotiation between the host aircraft and ATC.

In accordance with a still further exemplary and non-limiting embodiment, there is provided a method for displaying information related to an in-trail procedure (ITP) on an ITP display aboard a host aircraft. The method comprises rendering a vertical traffic scenario on a first section of the ITP display, and rendering a textual representation from the messages received from ATC on a second section of the ITP display substantially adjacent to the first section.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, brief summary or the following detailed description.

Techniques and technologies may be described herein in terms of functional and/or logical block components and with reference to symbolic representations of operations, processing tasks, and functions that may be performed by various computing components or devices. Such operations, tasks, and functions are sometimes referred to as being computer-executed, computerized, software-implemented, or computer-implemented. In practice, one or more processor devices can carry out the described operations, tasks, and functions by manipulating electrical signals representing data bits at memory locations in the system memory, as well as other processing of signals. The memory locations where data bits are maintained are physical locations that have particular electrical, magnetic, optical, or organic properties corresponding to the data bits. It should be appreciated that the various block components shown in the figures may be realized by any number of hardware, software, and/or firmware components configured to perform the specified functions. For example, an embodiment of a system or a component may employ various integrated circuit components, e.g., memory elements, digital signal processing elements, logic elements, look-up tables, or the like, which may carry out a variety of functions under the control of one or more microprocessors or other control devices.

For the sake of brevity, conventional techniques related to graphics and image processing, navigation, flight planning, aircraft controls, aircraft data communication systems, and other functional aspects of certain systems and subsystems (and the individual operating components thereof) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in an embodiment of the subject matter.

Figure 1:
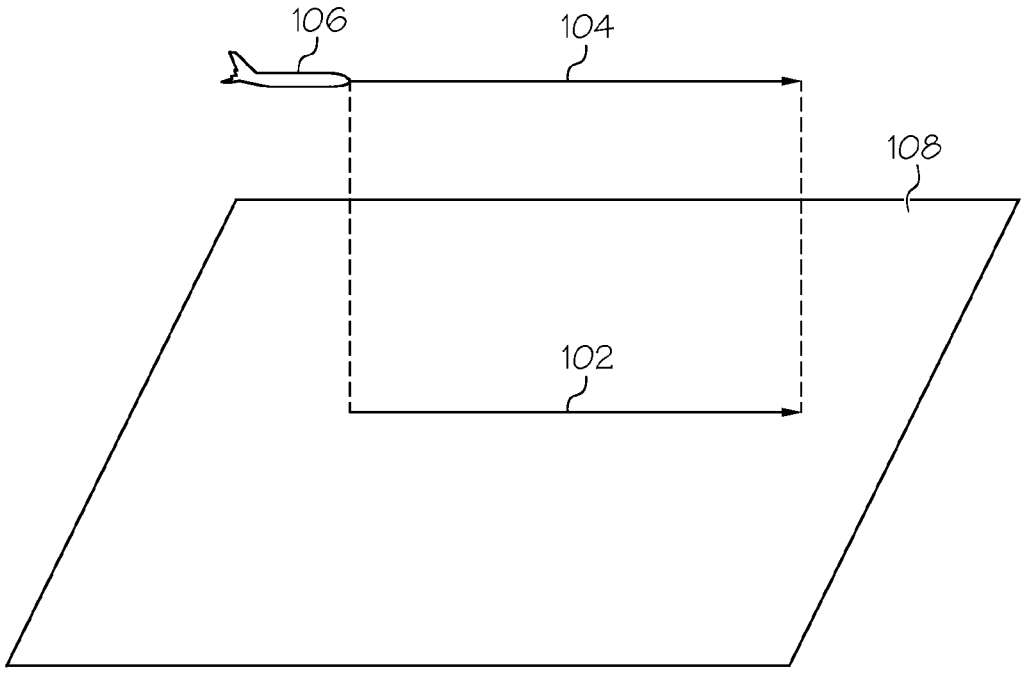
FIG. 1 illustrates the track associated with the flight path of an aircraft.

Although not always required, the techniques and technologies described here are suitable for use by aircraft using the ITP in an oceanic (or other) track system. For example, the techniques and technologies presented here could be used in connection with the ITP as defined and explained in Operational Improvements From Using the In-Trail Procedure in the North Atlantic Organized Track System, by Ryan C. Chartrand et al., National Aeronautics and Space Administration (October 2009) (hereinafter referred to as the "NASA Document"). For ease of understanding and clarity, the following description employs terminology that is consistent with that used in the NASA Document. Moreover, the relevant portions of the NASA Document are incorporated by reference herein. In this regard, FIG. 1 is a diagram that illustrates the track 102 associated with flight path 104 of an aircraft 106. The track 102 represents a projection of the flight path 104 onto a flat plane 108, which may correspond to the ground. Accordingly, the track 102 will be the same whether the aircraft 106 maintains a fixed altitude, climbs, or descends.

Figure 2:
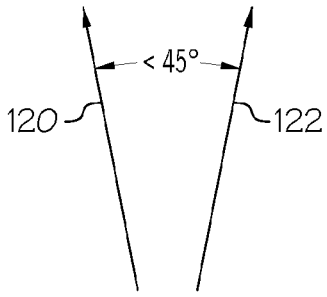
FIG. 2 illustrates the tracks associated with two different aircraft.
Figure 3:
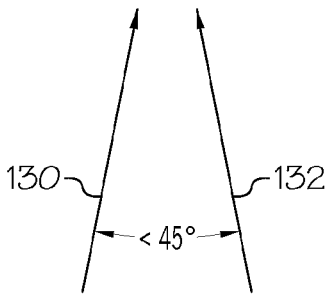
FIG. 3 also illustrates the tracks associated with two different aircraft.

The NASA Document specifies that the host aircraft and any neighboring aircraft of interest (i.e., a potentially blocking aircraft) must be "same direction" aircraft in order for an ITP flight level change to be requested. In this regard, "same direction" tracks are intersecting tracks (or portions thereof) having an angular difference of less than forty-five degrees. As an example, FIG. 2 is a diagram that illustrates the tracks 120 and 122 associated with two different aircraft. Even though the tracks 120 and 122 are divergent, they are considered to be in the same direction for purposes of the ITP because the angle between them is less than forty-five degrees. As another example, FIG. 3 illustrates the tracks 130 and 132 associated with two different aircraft. Even though the tracks 130 and 132 are convergent, they are considered to be in the same direction for purposes of the ITP because the angle between them is less than forty-five degrees.

An ITP is a protocol that can be followed when an aircraft seeks to change its flight level to a new flight level in the presence of a potentially blocking aircraft located at an intervening flight level. According to the NASA Document, the "ITP is intended to enable altitude changes that are otherwise blocked when aircraft are spaced at less than current separation standards at altitudes between the current and desired altitudes of a requesting aircraft." The ITP specifies some minimum separation between aircraft at the current and requested flight levels, to ensure safe altitude changes. Moreover, the ITP specifies certain criteria that must be satisfied before the host aircraft can issue a request for an ITP flight level change (such requests are issued to Air Traffic Control (ATC)). Although different criteria could be utilized by an embodiment of the subject matter described here, the NASA Document indicates the following ITP initiation criteria, where at least one of two conditions must be met: (1) if the ITP distance to a reference aircraft is greater than or equal to fifteen nautical miles (NM), and the groundspeed differential between the two aircraft must be less than or equal to twenty knots; or (2) if the ITP distance to a reference aircraft is greater than or equal to twenty NM, then the groundspeed differential between the two aircraft must be less than or equal to thirty knots.

Figure 4:
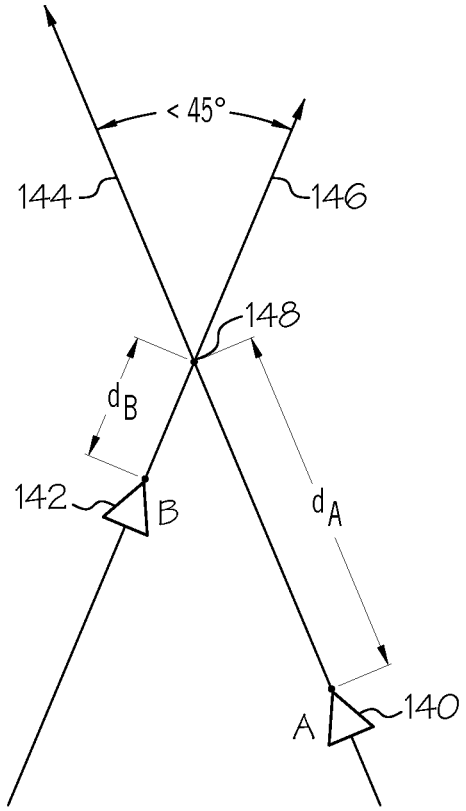
FIG. 4 is a diagram that illustrates the intersecting tracks associated with two different aircraft.

The ITP distance represents one appropriate measure of distance between the host aircraft and a nearby reference aircraft (a potentially blocking aircraft, which may be in front of or behind the host aircraft). Depending upon the particular embodiment, other distance metrics, distance measures, or relative spacing metrics could be used. For instance, the system might contemplate linear distance, time, aircraft acceleration, relative speed, closing rate, and/or other measurable or computable values that are dependent on the current geographic position, speed, acceleration, heading, attitude, or other operating status of the aircraft. The NASA Document defines the ITP distance as "the difference in distance to a common point along each aircraft's track." In this regard, FIG. 4 is a diagram that illustrates the intersecting tracks associated with two different aircraft. In FIG. 4, one aircraft 140 is labeled "A" and another aircraft 142 is labeled "B". The aircraft 140 has a corresponding track 144, and the aircraft 142 has a corresponding track 146 that intersects the track 144 at a point 148. Note that the aircraft 140 and 142 are considered to be in the same direction because the angle between the two tracks 144 and 146 is less than forty-five degrees. In FIG. 4, the label "dA" represents the current distance between the aircraft 140 and the point 148, and the "dB" represents the current distance between the aircraft 142 and the point 148. In this example, the ITP distance (dITP) is defined by the following expression: $d_{ITP}=|d_A-d_B|$.

Figure 5:
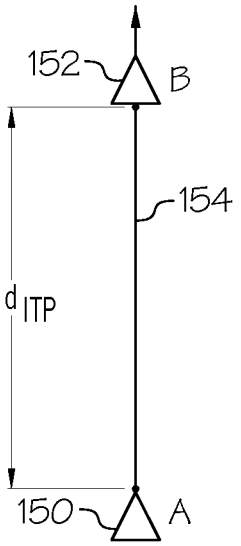
FIG. 5 illustrates the overlapping tracks associated with two different aircraft.

In another example, FIG. 5 is a diagram that illustrates the overlapping tracks associated with two different aircraft. In FIG. 5, one aircraft 150 is labeled "A" and another aircraft 152 is labeled "B". The two aircraft have a common or overlapping track 154. Consequently, the current distance between the two aircraft is also considered to be the ITP distance. In FIG. 5, "dITP" indicates the current ITP distance between aircraft 150 and aircraft 152.

The system and methods presented herein can be utilized to generate a flight deck display that includes a graphical indication of whether or not the ITP criteria is satisfied for the current flight conditions and a graphical and textual representation of the communication interactivity necessary for negotiating the ITP maneuver with ATC. A first region of the ITP display is similar in format to a typical vertical situation display (VSD) in that the host aircraft and neighboring aircraft are graphically represented in an elevation view using a vertical altitude scale. In a second region proximate the first region (e.g. adjacent thereto), the communications between the host aircraft and ATC are textually displayed. The pilot can select the desired flight level. The system will then automatically select a reference aircraft with knowledge of the environment in which the aircraft is operating, e.g., within an organized tracks system or not within an organized tracks system, or may indicate that ITP is not currently available If ITP is available, the pilot may update the selected reference traffic, or simply use the automatically chosen reference aircraft, and then request and execute the ITP maneuver while the graphical representation of the host aircraft is displayed within the opportunity region. The system may be coupled to a flight management system function that calculates when and to what flight level the host aircraft should climb to optimize efficiency.

Figure 6:
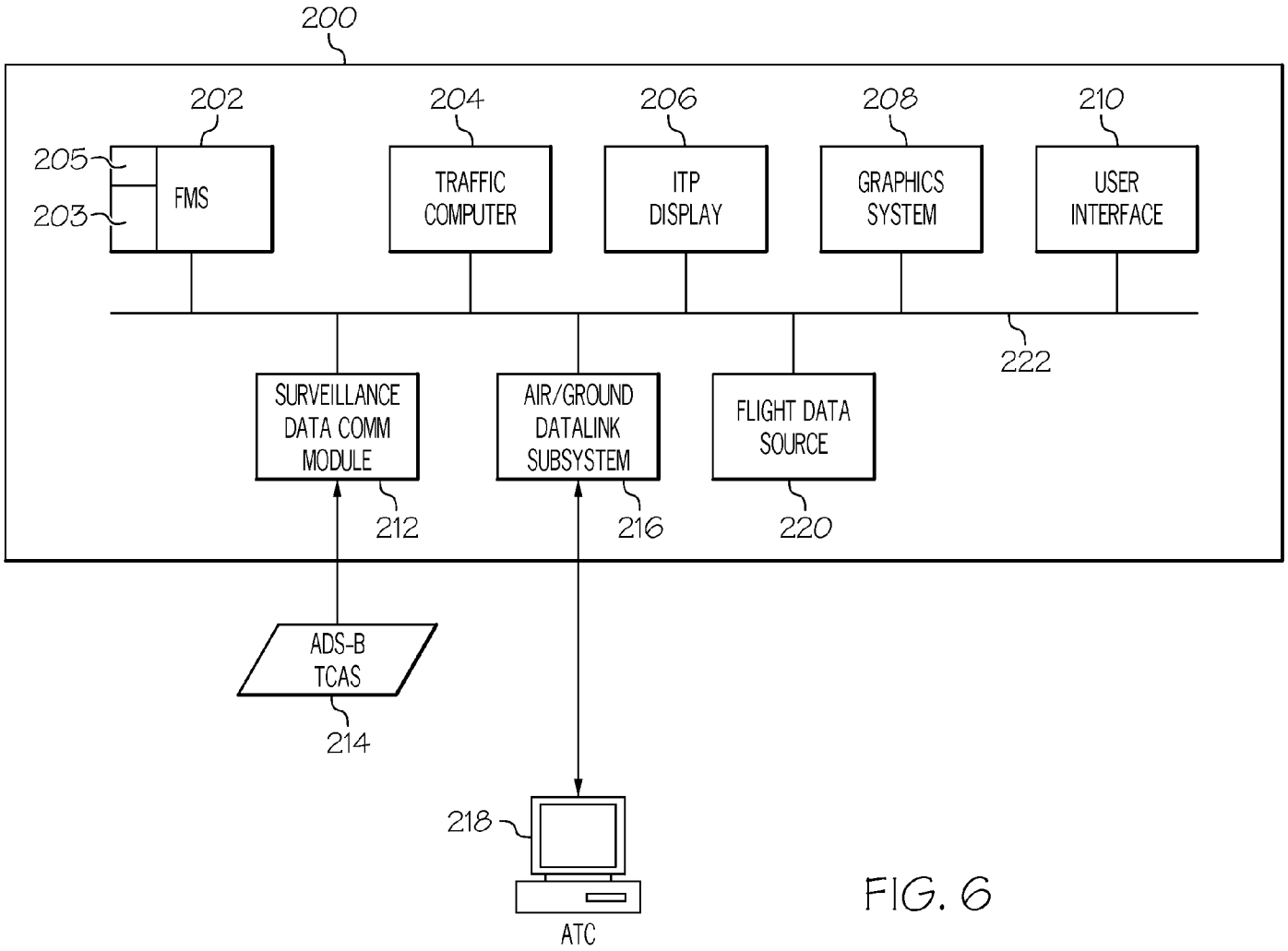
FIG. 6 is a schematic representation of an exemplary embodiment of a flight deck display system.

FIG. 6 is a schematic representation of an exemplary embodiment of a flight deck display system 200 that is suitable for use in a vehicle such as an aircraft. In exemplary embodiments, the display system 200 is located onboard the host aircraft, i.e., the various components and elements of the display system 200 reside within the host aircraft, are carried by the host aircraft, or are attached to the host aircraft. The illustrated embodiment of the display system 200 includes, without limitation: (1) a flight management system (FMS) including at least one processor 203 and an appropriate amount of memory 205 and of the type capable of acting as an Air Traffic Control (ATC) datalink manager; (2) a traffic computer 204 for processing data associated with a predetermined region relative to the host aircraft; (3) an ITP display element 206 configured to display ITP related data and which may or may not be associated with an integrated navigation display (INAV) for displaying traffic data; (4) a graphics system 208 that serves as the underlying driver of graphical information and displays and which processes inputs from (5) a user interface 210 such as a touch screen, cursor control device, or multi-function keyboard; (6) a surveillance data communication module 212 for receiving and processing data such as Automatic Dependent Surveillance-Broadcast (ADS-B) and Traffic and Collision Avoidance System (TCAS) data 214; (7) an air/ground datalink subsystem 216 that sends and receives datalink messages to and from ATC 218 via a digital datalink (e.g. VHF, HF, Satcom, etc.) including router and input/output functions; and (8) at least one source of dynamic flight status data 220 such as speed, altitude, position, etc. These elements of the display system 200 may be coupled together by a suitable interconnection architecture 222 that accommodates data communication, the transmission of control or command signals, and/or the delivery of operating power within the display system 200.

FIG. 6 is a simplified block diagram of a display system 200 that will be used for purposes of explanation and ease of description and is not intended to limit the application or scope of the subject matter in any way. In practice, the display system 200 and the host aircraft includes other devices and components for providing additional functions and features, as will be appreciated in the art. The display system 200 is depicted as a single unit; however, certain elements and components of the display system 200 (excluding the ITP display) may be implemented in a distributed manner using any number of physically distinct pieces of hardware or equipment.

The FMS 202 may include a general purpose processor, a content addressable memory, a digital signal processor, an application specific integrated circuit, a field programmable gate array, any suitable programmable logic device, discrete gate or transistor logic, discrete hardware components, or any combination designed to perform the functions described here. A processor device may be realized as a microprocessor, a controller, a microcontroller, or a state machine. Moreover, a processor device may be implemented as a combination of computing devices, e.g., a combination of a digital signal processor and a microprocessor, a plurality of microprocessors, one or more microprocessors in conjunction with a digital signal processor core, or any other such configuration.

Memory may be realized as RAM memory, flash memory, EPROM memory, EEPROM memory, registers, a hard disk, a removable disk, a CD-ROM, or any other form of storage medium known in the art. In this regard, the memory may be coupled such that the FMS 202 can obtain information from, and write information to, traffic computer 204. In practice, a functional or logical module/component of the display system 200 might be realized using program code that is maintained in the memory. For example, the graphics system 208, the surveillance data communication module 212, and/or the air/ground, datalink subsystem 216 may have associated software program components that are stored in the memory 205 (FIG. 6). That is, the memory 205 can be used to store data utilized to support the operation of the display system 200, as will become apparent from the following description.

In an exemplary embodiment, the ITP display 206 is coupled to the graphics system 208. The graphics system 208 is coupled to the FMS 202 such that FMS 202 and the graphics system 208 cooperate to display, render, or otherwise convey one or more graphical representations, synthetic displays, graphical icons, visual symbology, or images associated with operation of the host aircraft on the ITP display 206, as described in greater detail below. An embodiment of the display system 200 may utilize existing graphics processing techniques and technologies in conjunction with the graphics system 208. For example, the graphics system 208 may be suitably configured to support well known graphics technologies such as, without limitation, VGA, SVGA, UVGA, or the like.

In an exemplary embodiment, the ITP display 206 is realized as an electronic display configured to graphically display flight information including traffic information and the negotiations between the host aircraft and ATC and other data associated with operation of the host aircraft under control of the graphics system 208. In practice, the FMS 202 and/or the graphics system 208 produce image rendering display commands that are received by the ITP display 206 for purposes of rendering the ITP display. The display 206 is usually located within a cockpit of the host aircraft.

The illustrated embodiment of the display system 200 (FIG. 6) includes a user interface 210, which is suitably configured to receive input from a user (e.g., a pilot) and, in response to the user input, supply appropriate command signals to the FMS 202. The user interface 210 may be any one, or any combination, of various known user interface devices or technologies, including, but not limited to: a cursor control device such as a mouse, a trackball, or joystick; a keyboard; buttons; switches; or knobs. Moreover, the user interface 210 may cooperate with the ITP display 206 and the graphics system 208 to provide a graphical user interface. Thus, a user can manipulate the user interface 210 by moving a cursor symbol rendered on the display element 206, and the user may use a keyboard to, among other things, input textual data as will be more clearly described below.

In an exemplary embodiment, the surveillance data communication module 212 is suitably configured to support data communication between the host aircraft and one or more remote systems including ATC. More specifically, the surveillance data communication module 212 is used to receive the current flight status of other aircraft that are near the host aircraft. In particular, the data communication module 212 is implemented as an aircraft-to-aircraft data communication module that receives flight status data from an aircraft other than the host aircraft. For example, the data communication module 212 may be configured for compatibility with ADS-B technology, with TCAS technology, and/or with similar technologies.

The air/ground datalink subsystem 216 enables the host aircraft to communicate with Air Traffic Control (ATC). In this regard, the datalink subsystem 216 may be used to provide ATC data to the host aircraft and/or to send information from the host aircraft to ATC, preferably in compliance with known standards and specifications. Using the datalink subsystem 216, the host aircraft can send ITP requests to ground based ATC stations and equipment and receive ITP clearance or authorization from ATC (when appropriate) in a manner to be more fully described below such that the pilot can initiate the requested flight level change.

In operation, the display system 200 (FIG. 6) is also configured to process the current flight status data for the host aircraft. In this regard, the sources of flight data 220 generate, measure, and/or provide different types of data related to the operational status of the host aircraft, the environment in which the host aircraft is operating, flight parameters, and the like. In practice, the sources of flight status data 220 may be realized using line replaceable units (LRUs), transducers, accelerometers, instruments, sensors, and other well-known devices. The data provided by the sources of flight status data 220 may include, without limitation: airspeed data; groundspeed data; altitude data; attitude data, including pitch data and roll data; yaw data; geographic position data, such as GPS data; time/date information; heading information; weather information; flight path data; track data; radar altitude data; geometric altitude data; wind speed data; wind direction data; etc. The display system 200 is suitably designed to process data obtained from the sources of flight status data 216 in the manner described in more detail herein. In particular, the display system 200 can use the flight status data of the host aircraft when rendering the ITP display.

Figure 7:
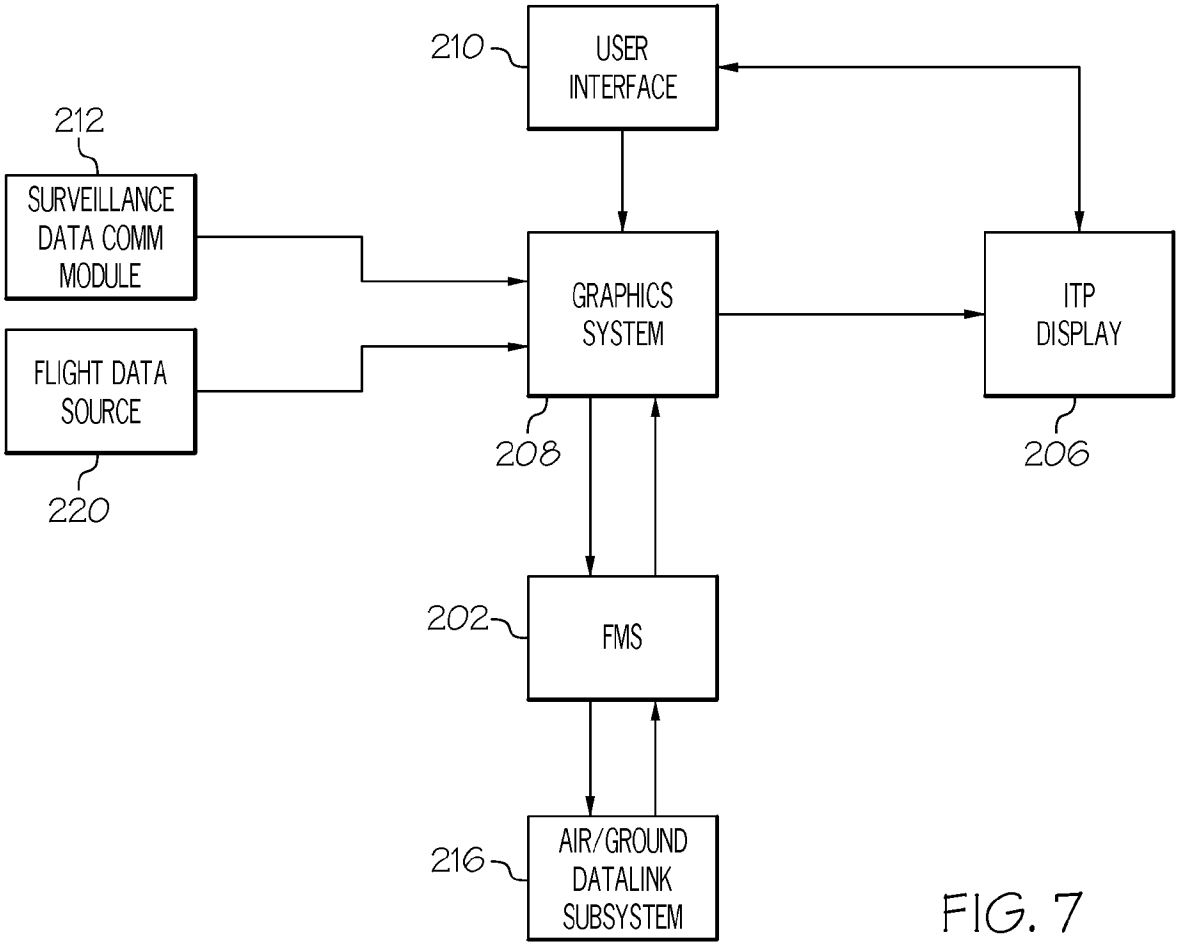
FIG. 7 is a schematic representation of an exemplary embodiment of an ITP display system.

FIG. 7 is a block diagram illustrating a system and method for presenting the traffic scenario associated with an ITP with the communication interactivity necessary for negotiating the ITP maneuver with ATC in accordance with an embodiment. As can be seen, graphics system 208 receives user interface data and commands from user interface 210, neighboring aircraft data (ADS-B In, TCAS) from Surveillance Data Communication Module 212, and aircraft altitude, speed, position, etc. from flight data source 220. Graphics system 208 formats this data and provides it to ITP display 206 for displaying a dynamic traffic scenario including the host aircraft and neighboring aircraft. Data in the form of commands, locations, screen data, and text data are exchanged between ITP display 206 and user interface 210. In addition to the display of the dynamic traffic scenario, the user interface may be utilized to conduct a negotiation with ATC of a request for an ITP maneuver. Symbology associated with this request is provided by user interface 210 to ITP display 206 for rendering thereon. Data and commands associated with this request are then provided to graphics system 208, which roughly formats the message data and responses for downlink and provides the roughly formatted data and responses to flight management system 202. Flight management system 202 then provides a fully formatted and addressed message or response to air/ground datalink subsystem 216 for transmission to ATC. Air/ground datalink subsystem 216 also provides fully formatted and addressed responses and message data from ATC to flight management system 202, which in turn provides fully decoded ITP message data and responses to graphics system 208 for display on ITP display 206. In this manner, the elements of the negotiation associated with a request for an ITP maneuver are displayed on the ITP display 206 along with the display of the dynamic traffic scenario thus reducing pilot workload. This will be described in more detail below in connection with FIGS. 8-31.

As was referred to previously, for a standard flight level change, an ATC controller employs standard, procedure-based, separation minima and procedures to ensure that separation will exist between an aircraft requesting a flight level change and all other aircraft at the initial, intermediate, and requested flight levels. ITP was developed to enable an aircraft to climb or descend to a desired flight level through intervening flight levels that might otherwise be disallowed because of either leading or following "same track" aircraft when using current standard separation minima.

Figure 8:
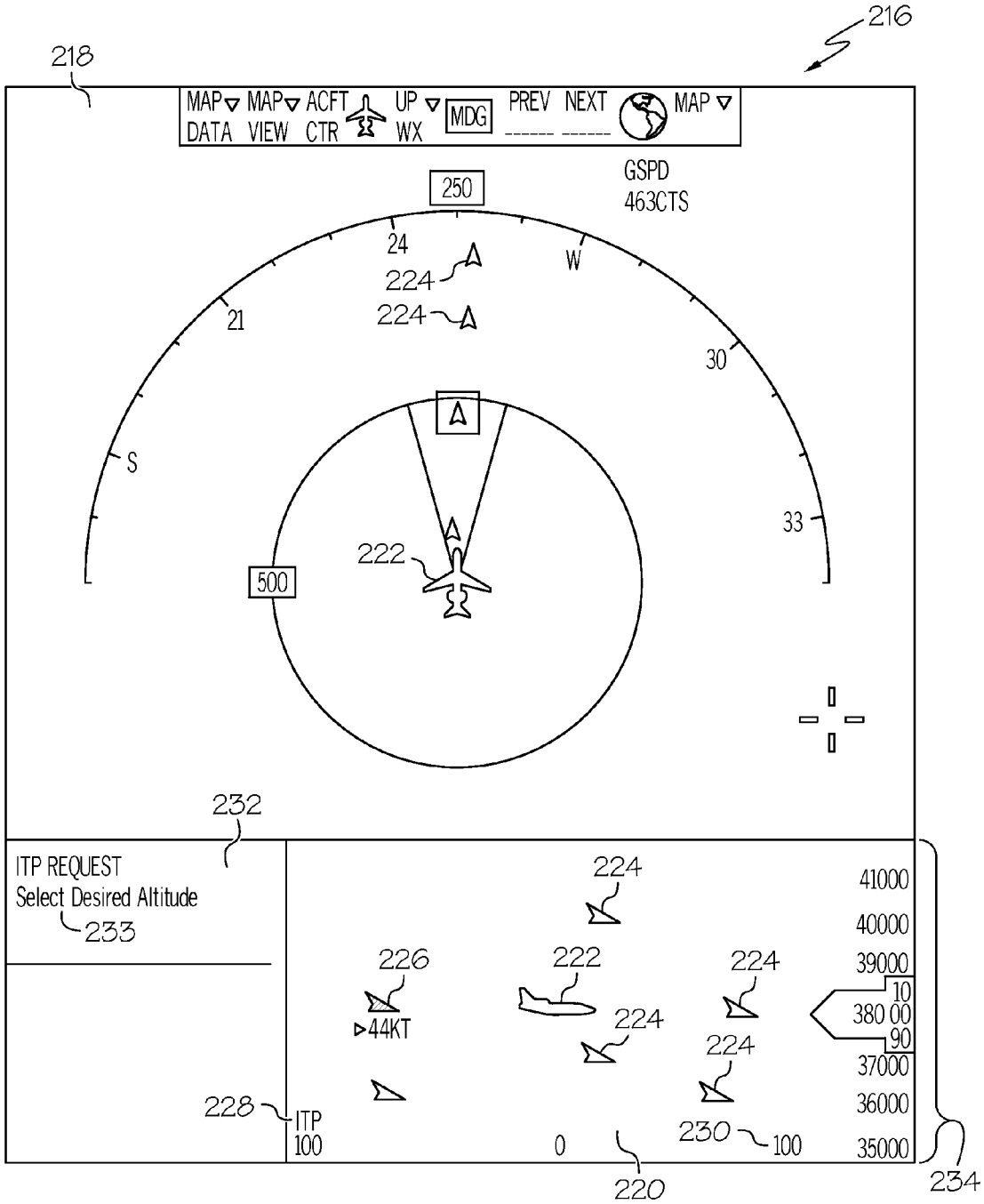
FIG. 8 is schematic representation of an exemplary display screen comprised of a lateral map (LMAP) section and an ITP display comprised of a Vertical Situation Display (VSD) window and an adjacent ITP Request (ISTF) window.

FIG. 8 is a graphical representation of an INAV display 216 including a lateral map (LMAP) display 218 and a vertical situation display (VSD) 220 showing top-down and vertical traffic scenario, respectively, of a host aircraft symbol 222 and neighboring aircraft 224. The ITP display also includes an ITP request window 232 that displays the elements of the ITP request and negotiation between the host aircraft 222 and ATC as will be more fully described below. The ITP request window is proximate or adjacent to VSD 220 and comprises a first region for primarily displaying text originating with host aircraft 222 and a second region for displaying text primarily originating with ATC.

If traffic aircraft meets all ITP criteria (also more fully described below), it is displayed as a hollow, unfilled shape; e.g., white, as, for example, is shown at 224. If, however, the ITP distance or ground speed differential does not meet the ITP initiation criteria, or the aircraft is not intervening and therefore is not valid for selection as a reference aircraft (more fully described hereinafter), the aircraft is displayed using a filled symbol 226 (e.g., gray) and may further comprise a data tag displaying the ground speed differential with respect to host aircraft 222 as is shown at 226. The ITP distance scale is fixed at, for example, 100 nautical miles (NM) behind (at 228) and 100 NM ahead (at 230) with host aircraft 222 remaining at "0" lateral ITP distance.

During a long oceanic flight, a pilot may wish to change the cruise flight level (climb or descend) if the current flight level is not favorable in terms of, for example, fuel efficiency, weather, etc. Upon initial ITP window activation, the default flight level selection is either the present altitude or a previously selected desired altitude.

The ITP request function includes means for requesting and graphically displaying a desired flight level. That is, the vertical situation display window 220 indicates the altitudes that are available for an ITP request by displaying, on a vertical scale 234, available flight levels in a first manner (e.g., in a first color) and invalid flight level s in a second manner (e.g., in a second color). This visually distinguishes the available flight level s from the invalid flight levels. Available altitudes are those for which (1) within the allowable delta from present altitude for ITP per industry standards (plus or minus 3,000 feet); (2) the altitude is greater than 1500 feet above or below the present altitude; (3) there is at least one aircraft at an intervening altitude within 2500 feet of the current ownship altitude displayed on the situation display window and with a data quality indicated as valid; (4) there are no aircraft at the desired altitude or at intervening altitudes within 15 NM of the ITP distance; (5) there are no aircraft at the desired altitude or at intervening altitudes and at an ITP distance greater than or equal to 15 NM and less than 20 NM with a rate of change of ITP distance greater than or equal to 20 knots closing; and (6) there are no aircraft at the desired altitude or at intervening altitudes and an ITP distance greater than or equal to 20 NM and less than 100 NM with a rate of change of ITP distance greater than or equal to 30 knots closing.

Figure 9:
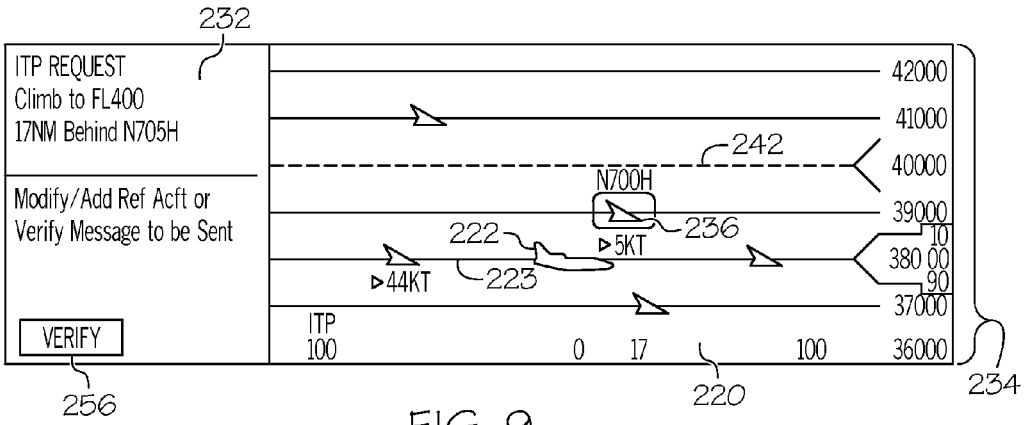
FIGS. 9-33 are schematic representations of exemplary ITP display screens.
Figure 10:
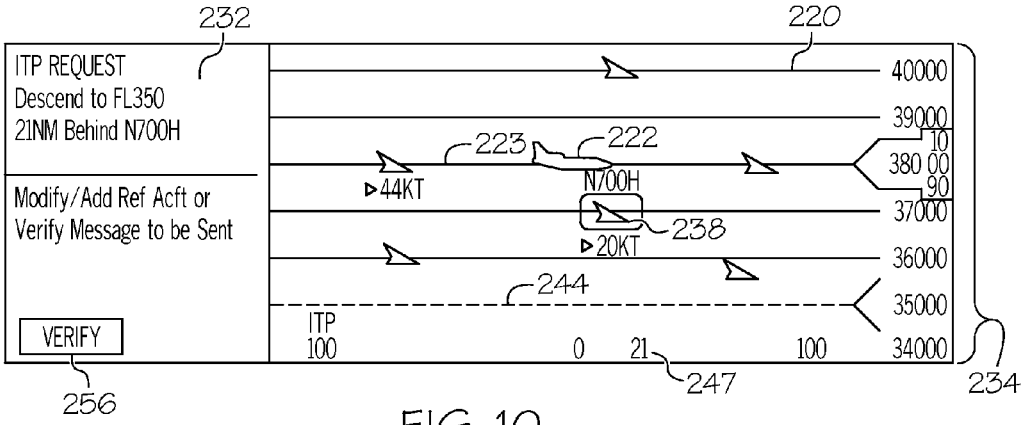
Figure 11:
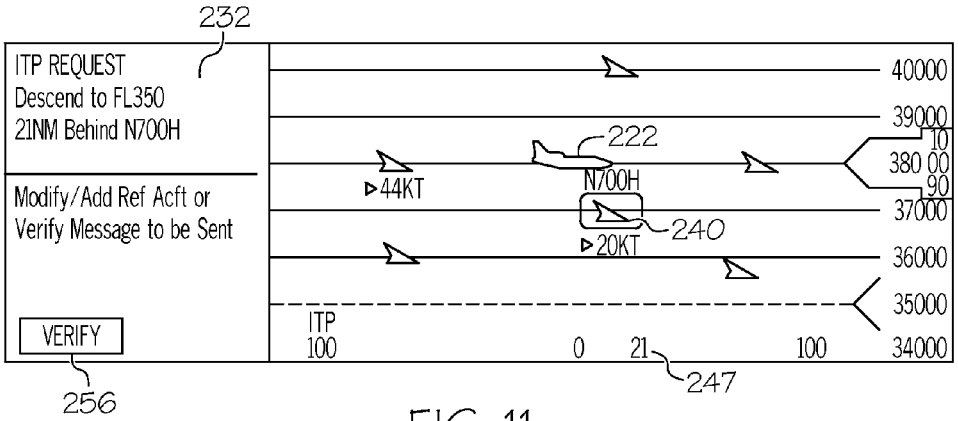
Figure 12:
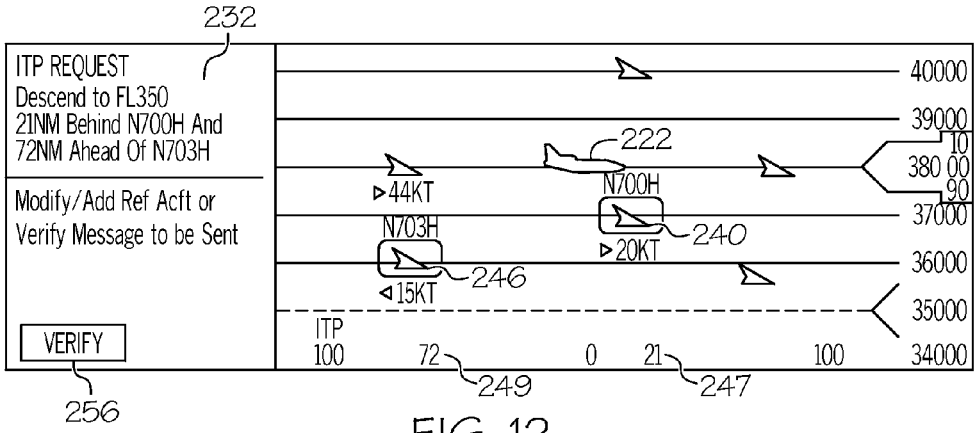

Vertical scale 234 defaults to a presentation of altitudes from 3000 feet below the ownship altitude to 3000 feet above the ownship altitude in increments of 1000 feet. A desired flight level may be graphically selected and visually differentiated as, for example, by generating symbology representative of a line corresponding to the desired flight level that may be dashed and/or colored (e.g., green) and/or otherwise highlighted. For example, in FIG. 9, ITP request window 232 displays symbology textually representative of a request for an ITP maneuver from FL380 to flight level FL400 graphically represented by dashed (or colored) line 242. ITP request window 232 also textually represents that the ownship 222 is "17 NM Behind N705H", a reference aircraft 236 (reference aircraft will be described in more detail below). In FIG. 10, ITP request window 232 displays symbology textually representative of a request for an ITP maneuver from flight level FL380 223 to flight level FL350 graphically represented by dashed (or colored) line 244. ITP request window 232 also textually displays that the ownship 222 is "21 NM Behind N700H", a reference aircraft 238. Scrolling lateral map display 220 shifts the location of the ownship altitude as shown in FIGS. 9 and 10 permitting a better view of intervening aircraft for the desired flight level. However, the ownship flight level is not permitted to scroll off-screen thus hiding the current flight level. The additional verbiage in the ITP request window 232 in FIGS. 9 and 10 including "VERIFY" button 256, will be described below.

A request for clearance of an ITP maneuver requires a minimum of one and a maximum of two reference aircraft. When selected as an ITP reference aircraft, the traffic symbol becomes visually distinguished; e.g., translucently highlighted in, for example, green and encircled with a rounded edge box (e.g. green). The flight ID is displayed above the symbol, and the closure rate is displayed below the symbol. This is shown at 240 in FIG. 11 where the flight ID N700H is shown above symbol 240, and the closure rate greater than 20 KT is shown below symbol 240. When a single reference aircraft is selected as shown at 240 in FIG. 11, the text formulation in the ITP request window 232 is updated with the reference aircraft 240 ITP distance and flight ID. When a second aircraft is selected as an ITP reference aircraft as is shown at 246 in FIG. 12, the traffic symbol for that aircraft is also visually distinguished as previously described with the flight ID N703H displayed above symbol 246 and the closure rate less than 15 KT below. The graphical representation of the text formulation in the ITP request window 232 is updated to include the reference aircraft 246 ITP distance and flight ID. The relative distances of the reference aircraft 240 and 246 with respect to ownship 222 is displayed on ITP distance scale as "21" NM ahead of and "72" NM behind, respectively, ownship 222 as shown at 247 and 249, respectively, in FIGS. 11 and 12.

Figure 13:
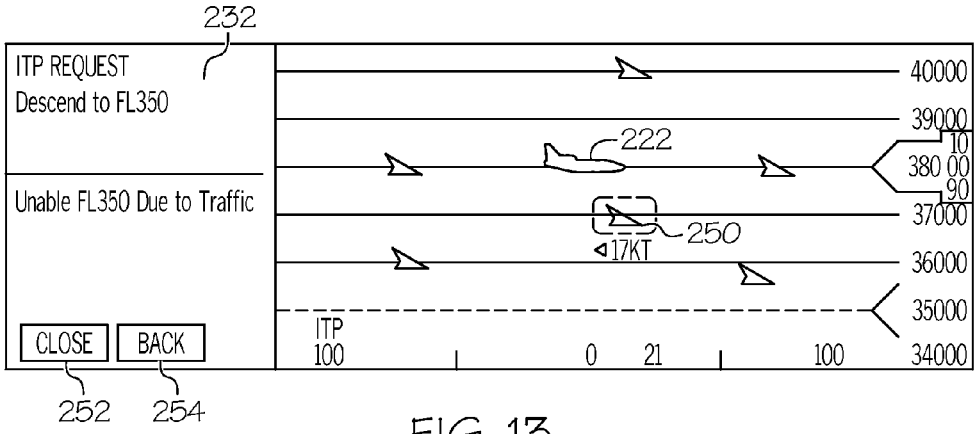
Figure 14:
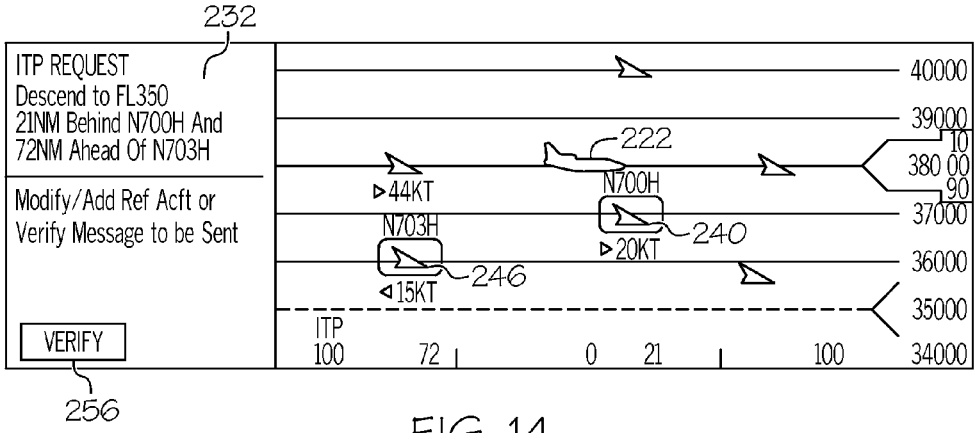
Figure 15:
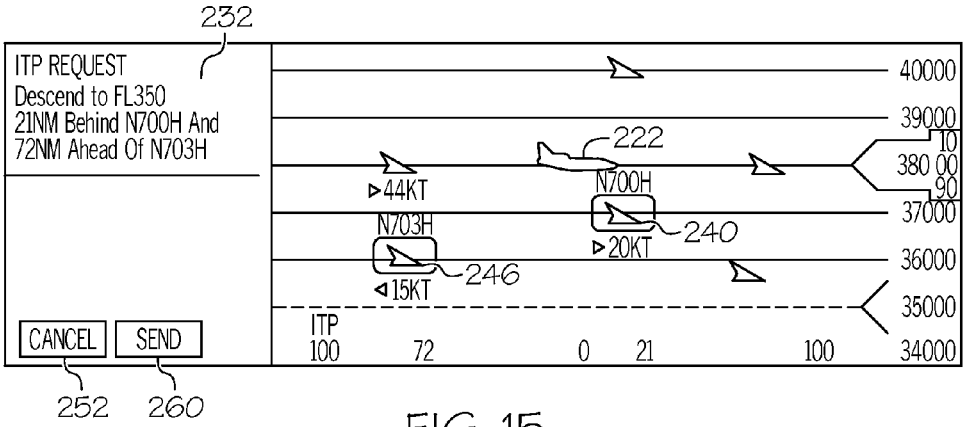
Figure 16:
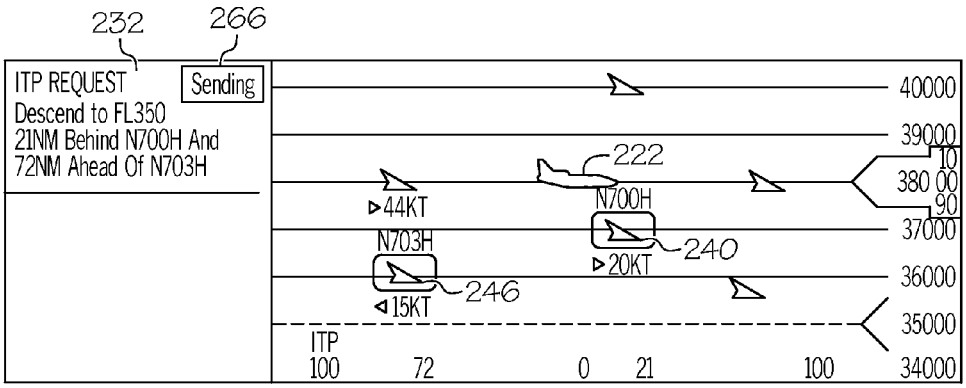
Figure 17:
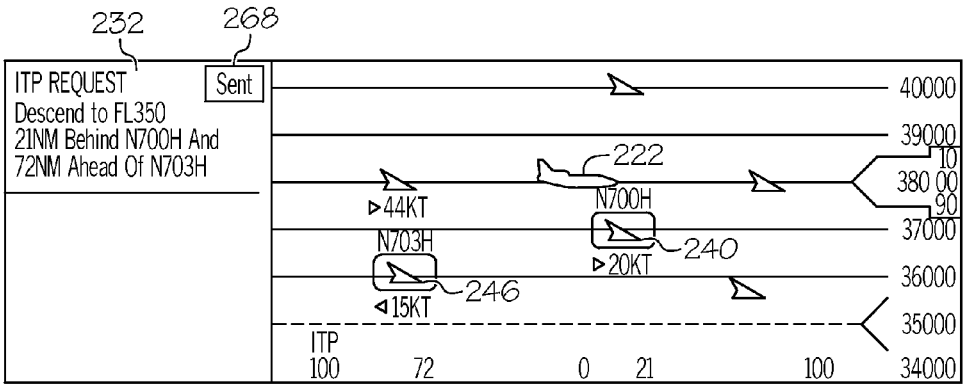
Figure 18:
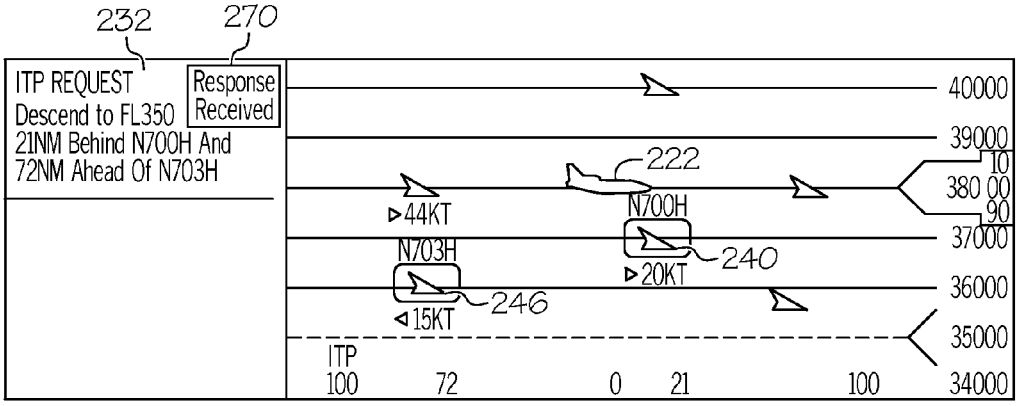
Figure 19:
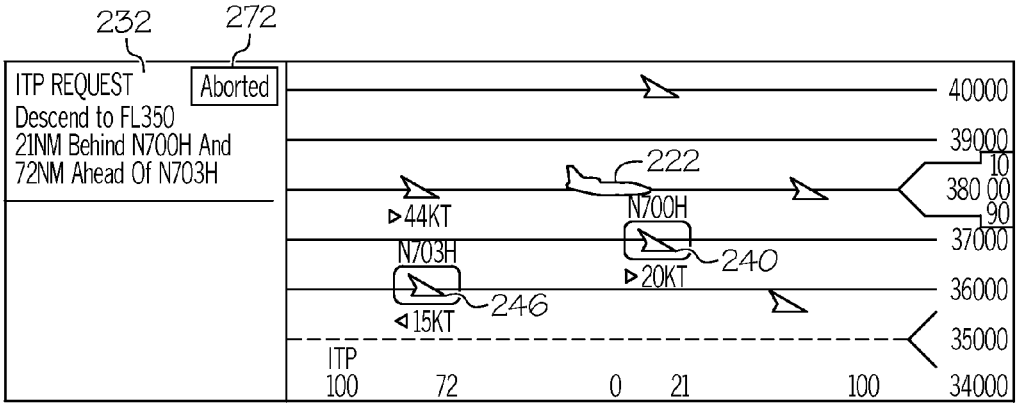

Referring to FIG. 13, if an ITP reference aircraft that previously met the ITP criteria and was selected as a reference aircraft reaches a state where it longer satisfies the ITP criteria, it becomes automatically deselected by altering its symbology to indicate that it is no longer valid as an ITP reference aircraft as is shown at 250 in FIG. 13. In this case, coloring may be removed and the rounded box is altered; e.g., becomes dashed. Furthermore, its ITP distance and flight ID are removed from the ITP request window 232 as shown in FIG. 13. Selection of the BACK option 254 clears the ITP request window 232 and all previous selections, returning it to the default view at initiation. Selection of the CLOSE option 252 cancels the ITP request operation closing the window. If a valid selected altitude is present, at least one valid ITP reference aircraft is present in the ITP text formulation, and there is an active connection with ATC, the VERIFY button 256 displayed and enabled as shown in FIG. 14. When the VERIFY button 256 is enabled and selected, the data entries in the ITP request window 232 become locked (i.e., no changes to the selected altitude or reference aircraft are permitted), and CANCEL and SEND buttons, 258 and 260 respectively, are graphically presented as shown in FIG. 15. When the SEND button 258 is enabled and selected, an ITP downlink message, comprising an altitude request and free text, is forwarded to air/ground datalink subsystem 216 (FIG. 6) for transmission to ATC 218, and the ITP request window 232 remains locked; i.e. no changes to the selected altitude or reference aircraft will be permitted. As shown in FIGS. 16, 17, 18, and 19 respectively, the upper right area of the ITP request window 232 is updated with downlink status messages "Sending" 266 when the request is pending, "Sent" 268 when the request is actually sent, "Response Rcvd" 270 when a response from ATC is received, and "Aborted" 272 in the event of a failure.

When a CANCEL button (258 in FIG. 15) is enabled and selected, modifications to the selected altitude and reference aircraft are re-enabled, the ITP ranges for the presently selected reference aircraft are recomputed and updated to the latest values, and the CANCEL and SEND options, 258 and 260 respectively, are removed and replaced by the VERIFY button 256.

Figure 20:
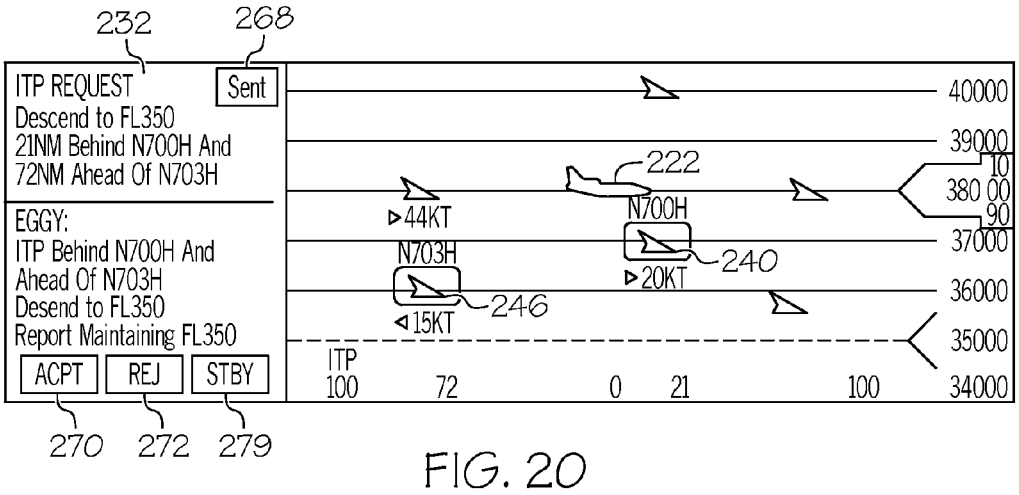

As should now be apparent, the ITP request window 232 on the ITP display provides ITP availability status and other applicable information such as ITP text content after reference aircraft are selected. FIG. 20 illustrates the initial state of the ITP request window 232 on the ITP display to the left of the VSD in a manner that does not obscure the vertical situational view. In addition to the examples already described above, the following table contains additional exemplary textual messages that that may be provided in the ITP request window 232.

| TEXT PRESENTED | STATUS INDICATION |
|---|---|
| Max Alt = 46000 FT | ITP desired altitude selection invalid due to aircraft performance |
| ITP Not Available | No available reference aircraft |
| Select Desired Altitude | ITP desired altitude entry needed |
| Modify/Add Ref Acft or Verify Message to be Sent | ITP reference aircraft selections may be modified |
| Select Reference Aircraft | ITP reference aircraft selection required |
| No Active Center | No active datalink connection |
| Unable FL350 Due to | ITP unavailable due to blocking |

-continued

| TEXT PRESENTED | STATUS INDICATION |
|---|---|
| Traffic | aircraft |
| Descend to FL350 | ITP request sent |
| 21NM Behind N700H And 72NM Ahead Of N703H | |
| EGGY: | ITP response received |
| ITP Behind N700H And Ahead Of N703H | |
| Descend To FL350 | |
| Report Maintaining FL350 | |
| Begin Maneuver | Begin ITP maneuver climb or descent |

Figure 21:
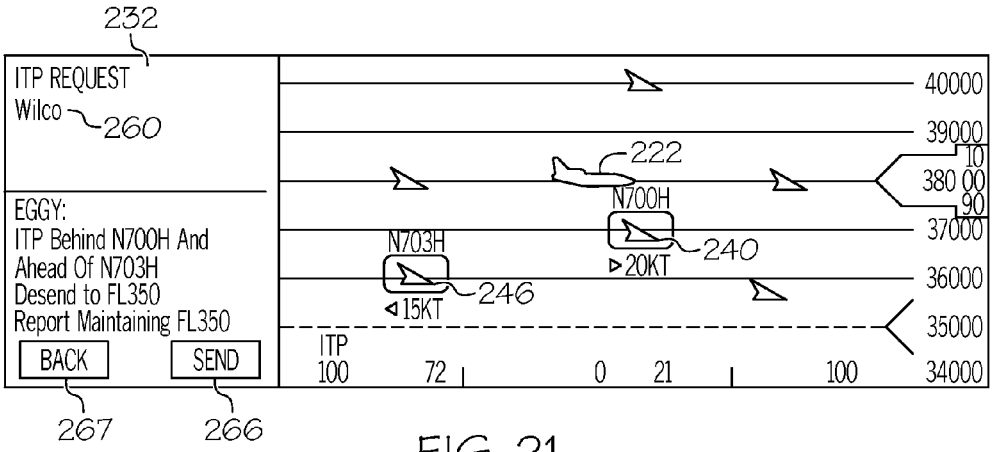

After an ITP request has been sent, the ITP request window 232 displays the text of the response provided by the ATC center ("EGGY" identifier for Shanwick, England shown for example) as shown in FIG. 20. This enables the crew to compare the received response to the sent request shown in the ITP request window 232. When the response to the ITP request requires a response from the aircraft, the ITP request window 232 will display one or more buttons associated with options from which to select a desired response; e.g., an accept button 270 (ACPT), a reject button 272 (REJ), and a standby button 279 (STBY) as shown in FIG. 20. The selected response is then forwarded to ATC. If the accept button (ACPT) is selected, the ITP request window 232 changes to appear as shown in FIG. 21. If the SEND button 266 is then selected, an ITP downlink message (i.e. Wilco) will be forwarded to ATC as shown at 260 in FIG. 21. If, instead, the BACK button 267 is selected in FIG. 21, the back and send options are removed and replaced with the previous selections.

Figure 22:
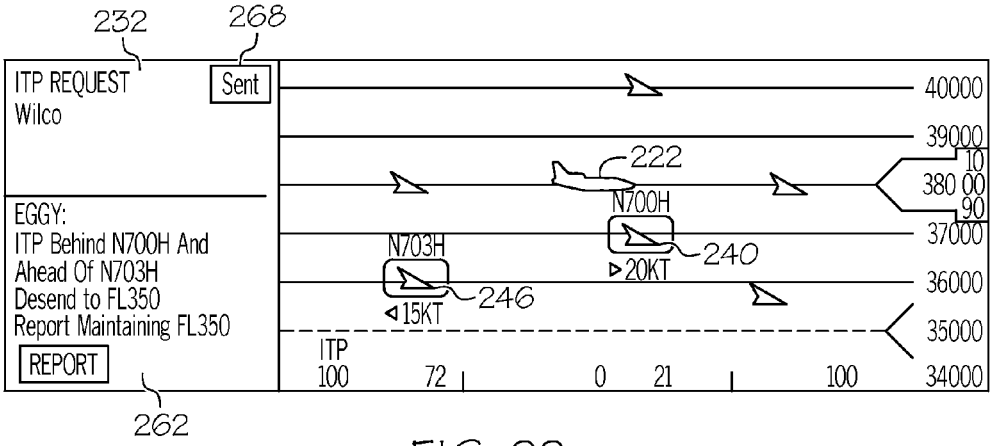
Figure 23:
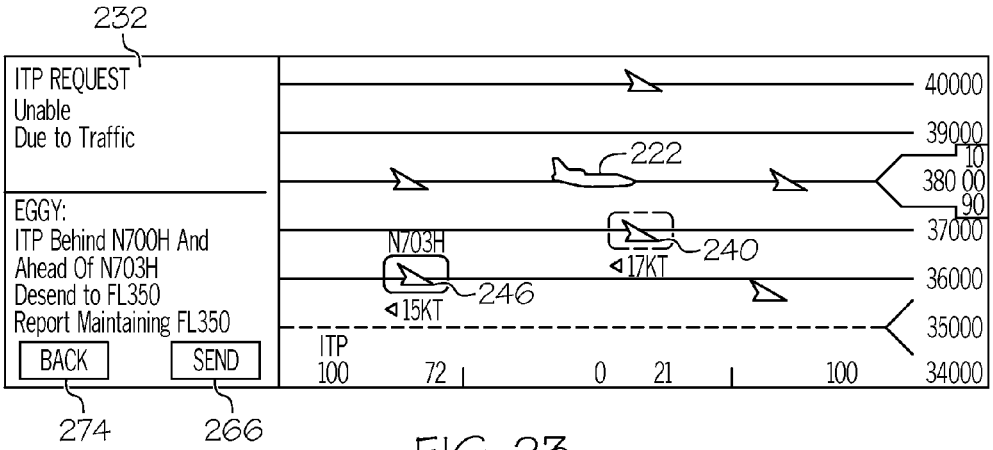
Figure 24:
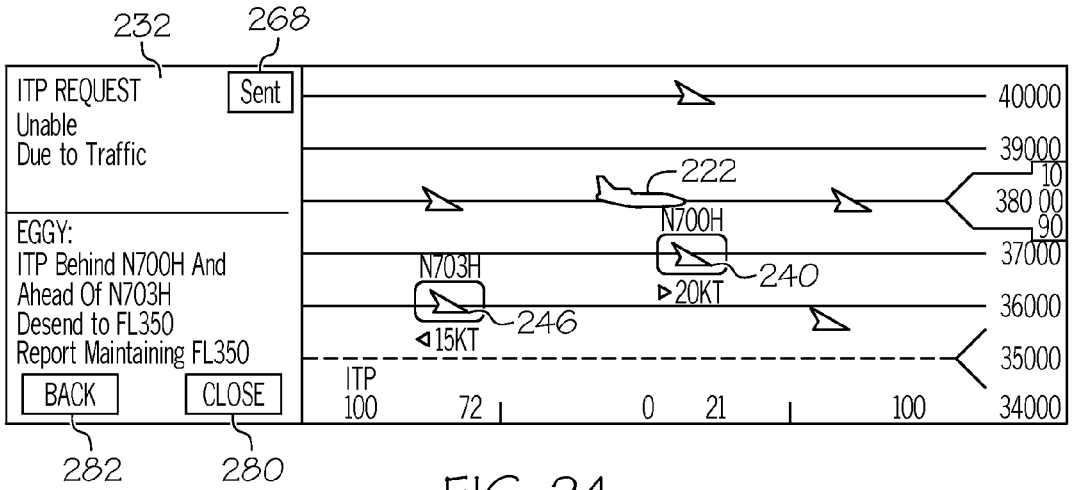
Figure 25:
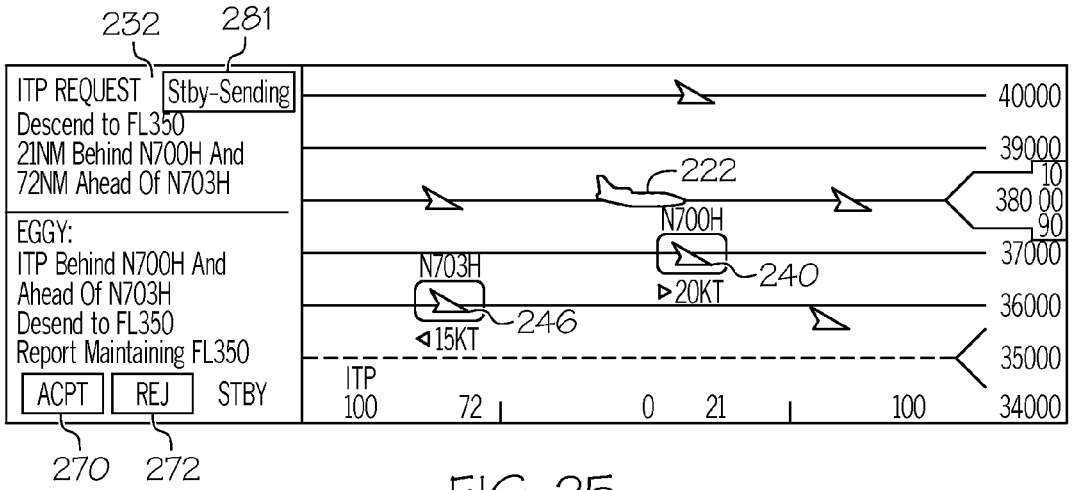
Figure 26:
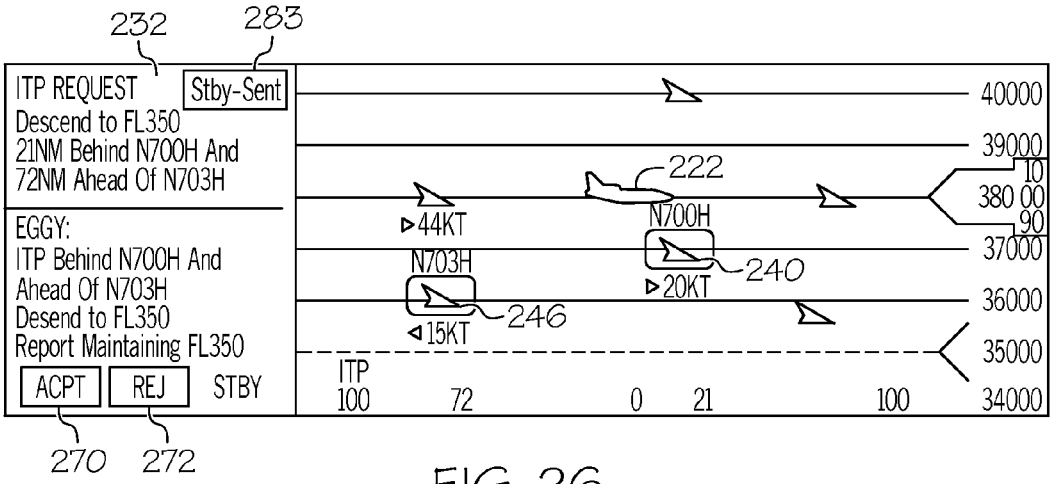

When an indication has been received that the accept response was successfully sent ("Wilco"), the ITP request window 232 appears as shown in FIG. 22, which displays a REPORT button 262 that enables arming an automated "Report Maintaining" message, indicating that the host aircraft is maintaining FL350, to comply with industry standards (RTCA Doc. D0306, Change 1) that define which messages will be exchanged. If the reject button 272 (REJ) is selected in FIG. 20, the ITP request window 232 changes to that shown in FIG. 23 ("i.e. Unable Due To Traffic"). When the SEND button 266 in FIG. 23 is enabled and selected, the ITP request downlink message composed of a rejection and formatted free text will be forwarded to ATC ("Unable Due To Traffic"). FIG. 23 illustrates an example where the traffic situation has changed since the ITP request was sent. The reference traffic ahead of the aircraft has slowed and now no longer complies with the ITP separation criteria. It has become highlighted, and the crew has selected the "REJECT" option to reject the uplinked altitude clearance since the traffic scenario no longer matches what was provided to ATC in the negotiation. Alternatively, if the BACK button 274 is enabled and selected (FIG. 23), the back and send options are removed and replaced with previous selections. When it is indicated that the reject response was successfully sent, the ITP request 232 window appears as shown in FIG. 24 (i.e. "Sent"). Selection of the CLOSE button 280 immediately closes the ITP request window 232. Selection of the BACK button 282 returns the ITP request window 232 window and all selections to the state prior to sending a request. Selection of the standby button 279 (STBY) in FIG. 20 changes the ITP request window 232 to appear as shown in FIG. 25 ("Stby-Sending"). When ATC indicates that the standby response was successfully sent, the ITP request window 232 appears as shown in FIG. 26 ("Stby-Sent").

Figure 27:
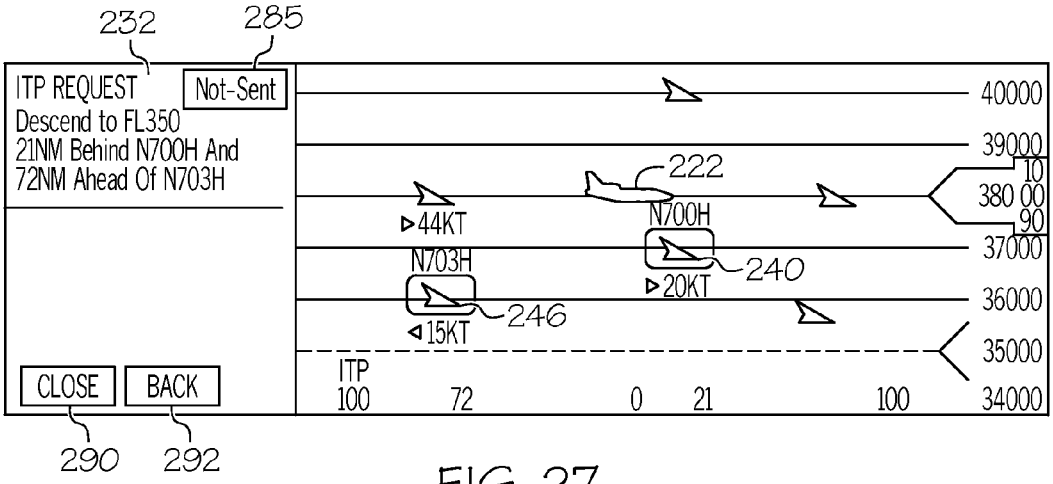
Figure 28:
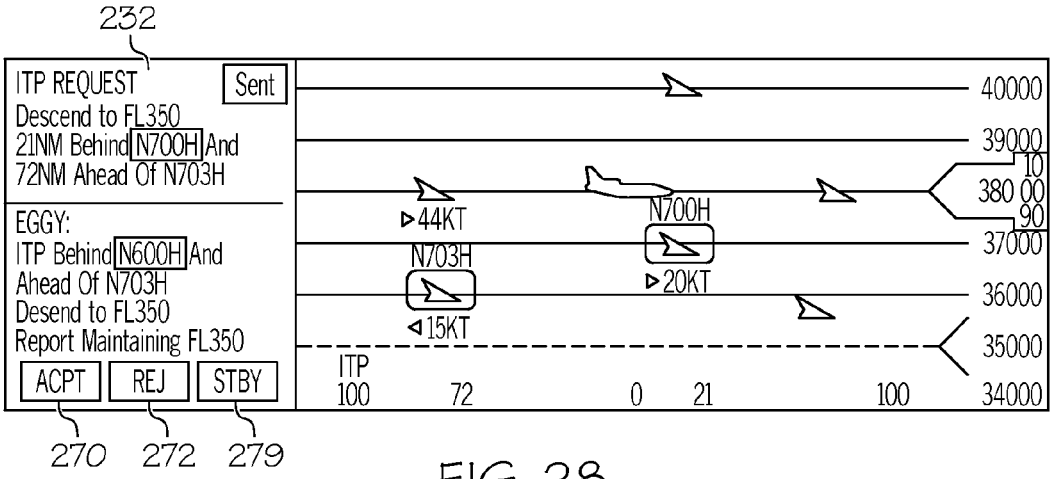

If a downlink response that has been forwarded for transmission has timed out due to a lack of an acknowledgement, the ITP request window 232 appears as shown in FIG. 27; i.e. a "Not Sent" textual message 285 graphically appears in the upper right hand corner and CLOSE and BACK buttons, 290 and 292 respectively, appear at the bottom. The lack of a network acknowledgement implies that the connection with ATC has been lost and must be reacquired. Selection of the CLOSE button 290 immediately closes the ITP window, while selection of the BACK button 292 clears the ITP request window 232 and all selections, returning it to the default view.

Figure 29:
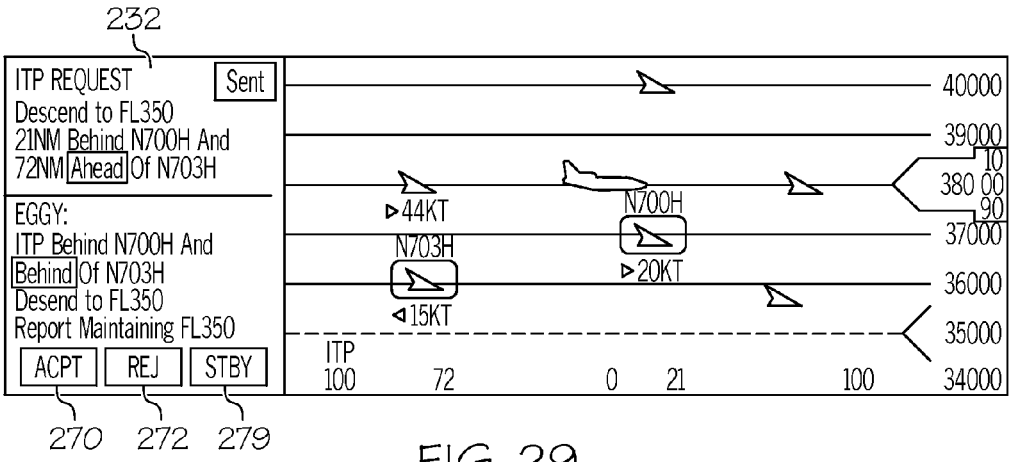
Figure 30:
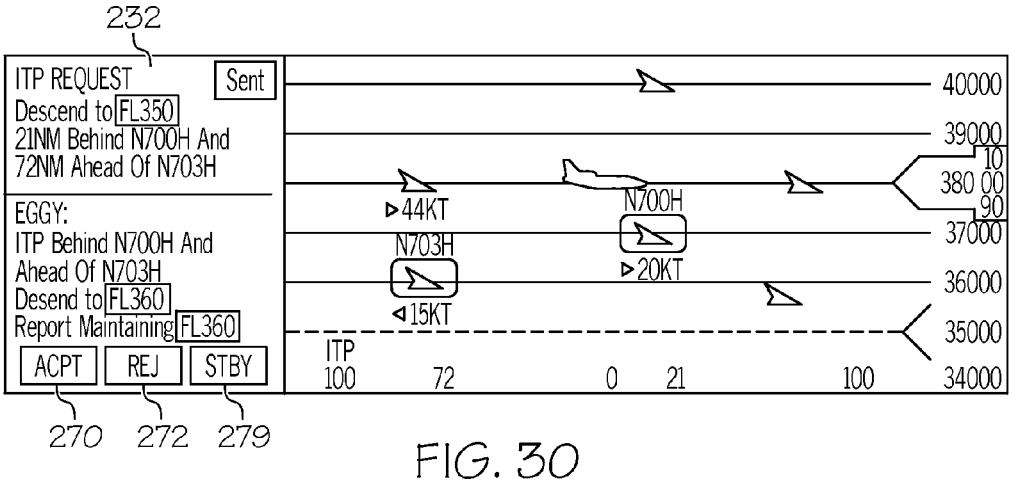

After an ITP request has been sent and a response received, the data received (including one or two aircraft identifications, the requested flight level, and the Ahead or Behind indications) is compared to the request sent and any mismatches highlighted. For example, in FIG. 28, the request indicates that the descent to FL350 is 21 NM behind "N700H" whereas the response indicates that it is behind "N600H" thus presenting a mismatch. In FIG. 29, the request indicates a reference aircraft 72 NM "Ahead" of N703H whereas the response indicates that the descent is "Behind" N703H indicating another mismatch. In FIG. 30, the request indicates a descent to "FL350" while the response indicates a descent to "FL360" demonstrating another type of mismatch. In each case, the accept button 270 (ACPT) is disabled, leaving only remaining options reject 272 (REJ) and standby 279 (STBY).

Figure 31:
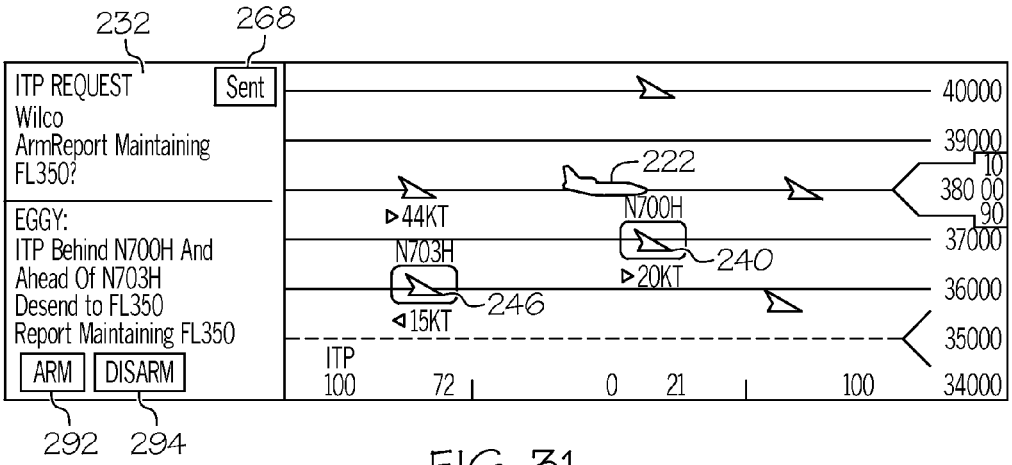
Figure 32:
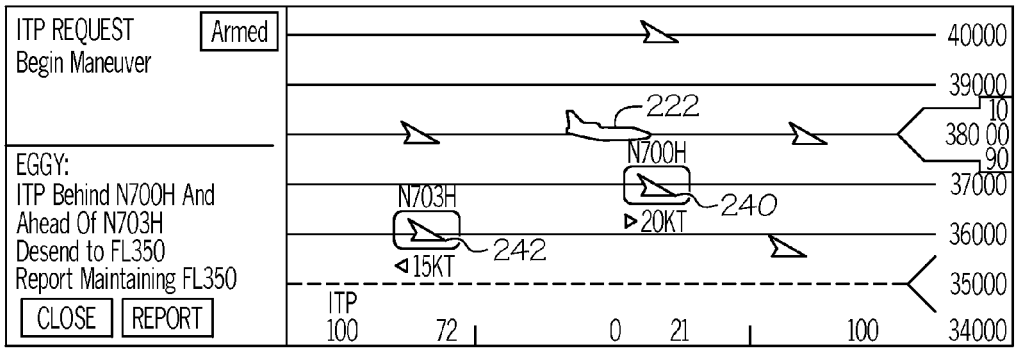
Figure 33:
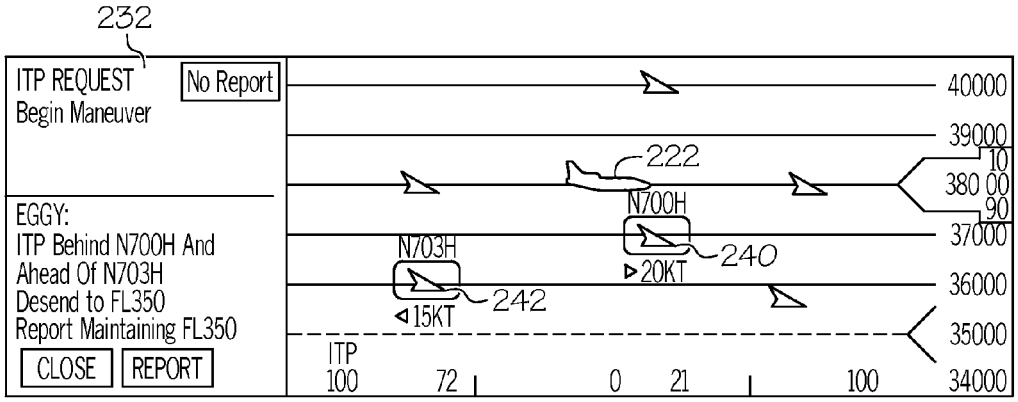

Referring back to FIG. 22, when the report prompt 262 is selected, ITP request window 232 appears as shown in FIG. 31 and includes an ARM button 292 and a DISARM button 294. The arming process allows the crew to activate an automatic downlink message transmittal to ATC upon the occurrence of a specific event. In the case of an ITP and as shown in FIGS. 31 and 32, the expectation is that the aircraft will send a downlink message to ATC upon reaching the assigned flight level (i.e. FL350). Upon selection of the ARM button 292, the request window 232 appears as shown in FIG. 32 and automatically transmits a report to ATC when the clearance altitude is reached ("Armed" 297). Selection of the DISARM button 294 changes the request window 232 to appear as shown in FIG. 33 and indicates the status just prior to the ITP maneuver ("No Report" 299).

Figure 34:
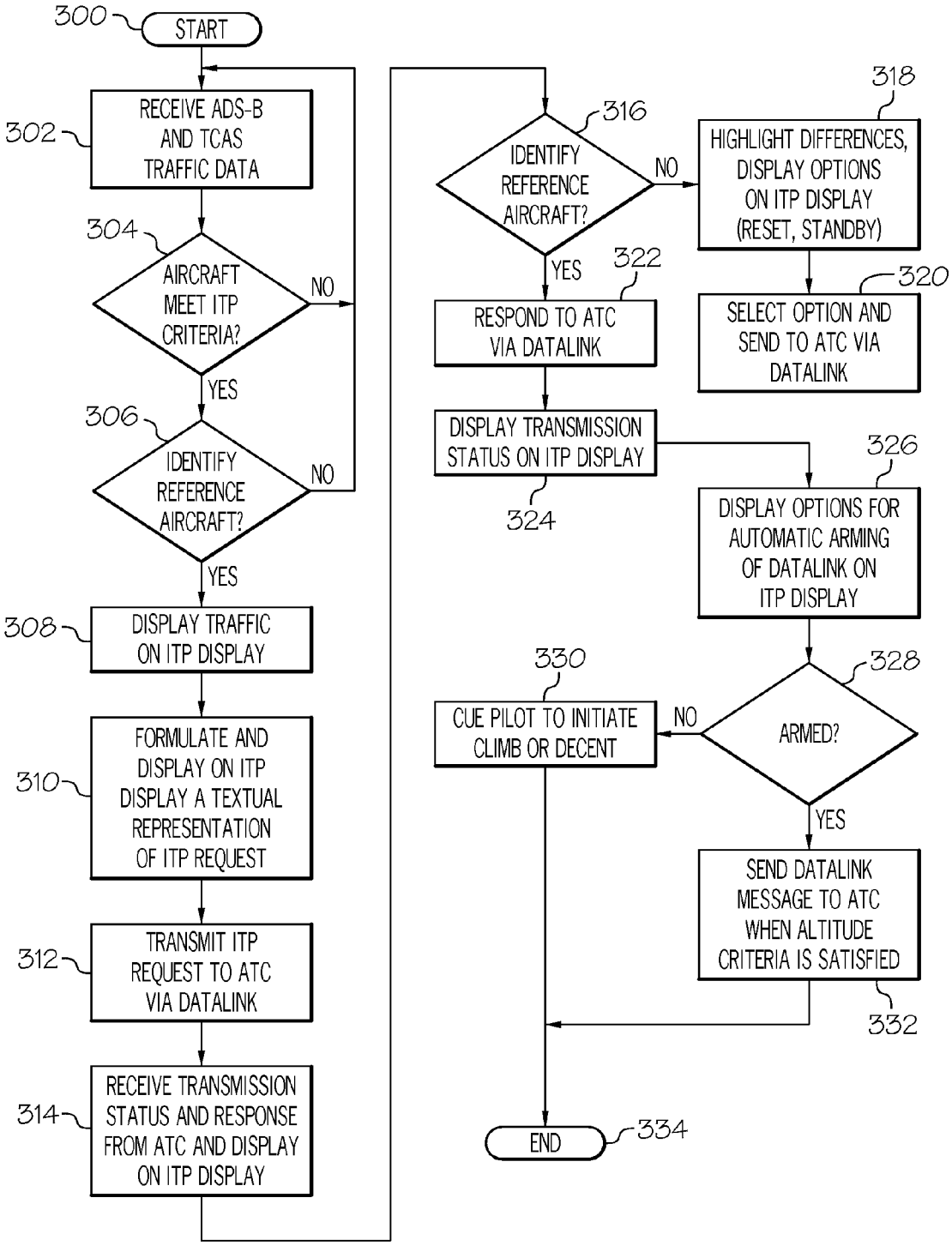
FIG. 34 is a flow chart describing a method for displaying the ITP vertical traffic scenario and a textual representation of the ITP negotiation between a host aircraft and ATC on an ITP display.

FIG. 34 is a flow chart of a method 300 for displaying graphically or textually symbology representative of a vertical traffic scenario associated with an ITP and the corresponding communication interactivity between the host aircraft and ATC related to negotiating the ITP. First, ADS-B and TCAS transmitted data (214 in FIG. 6) is received from nearby aircraft and provided to surveillance data communication module 212 (STEP 302). In STEP 304 and STEP 306, aircraft meeting ITP criteria and qualifying as reference aircraft are displayed on the ITP display; more specifically, on the of the VSD portion of the ITP display (STEP 308). In STEP 310, a textual representation of an ITP request is formulated and displayed on the ITP display (206 in FIGS. 6 and 7). The ITP request is then transmitted to ATC via datalink (316 in FIGS. 6 and 7) (STEP 312).

In STEP 314, an ITP response, clearance, and transmission status is transmitted from ATC to the aircraft via datalink. The clearance includes the original ITP request. A comparison is made to determine if the original ITP request matches the ATC clearance (STEP 316). If they do not match, the difference will be highlighted on the ITP display, and the pilot will be offered the options of resetting or entering a standby mode (STEP 318) by activating an appropriate button appearing on the ITP display. The selected option is sent to ATC via datalink (STEP 320). If the ITP request and the ATC response match (STEP 316), a response is sent to ATC via datalink (STEP 322), and the transmission status is displayed on the ITP display (STEP 324).

In STEP 326, options are displayed on the ITP display for the automatic arming of the datalink. If armed (STEP 328), the pilot is cued to initiate the climb or descent AND a datalink message is sent to ATC when the altitude criteria are satisfied (STEP 332). If not armed, (STEP 328), the pilot is cued to initiate the climb or descent, no message will be sent (STEP 330). That is, the arming process allows the crew to activate an automatic downlink message transmittal to ATC upon the occurrence of a specific event. For example, in the case of an ITP, ATC may request "Report Maintaining FL350". The expectation is that upon reaching the assigned flight level, the aircraft will send a downlink message to ATC informing them of such. The Flight Management System will send this message automatically if it has been armed by the pilot.

Thus, there has been provided a system and method for combining presentation of the traffic scenario associated with an ITP on the VSD of an ITP display with a textual representation of the communication interactivity between the requesting aircraft and ATC necessary to negotiate an ITP maneuver.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A method for displaying information related to an in-trail procedure (ITP) on a display aboard a host aircraft, the method comprising:

obtaining, by a graphics system, current flight status data of the host aircraft via a flight data source, and of at least a second aircraft, via a data communication module;

rendering on the display a vertical traffic scenario including at least the host aircraft and the second aircraft; and rendering on the display, proximate the vertical traffic scenario, a textual representation of an ITP request from the host aircraft;

transmitting, via an air/ground datalink subsystem, the ITP request to air traffic control (ATC) for approval of an ITP maneuver;

receiving from ATC, via the air/ground datalink subsystem, and displaying, (i) a first transmission status and (ii) an ATC clearance containing the ITP request;

rendering on the display the ATC clearance; and displaying a graphical representation of options for arming a datalink report associated with the ATC clearance when the ITP request matches the ATC clearance.

2. The method of claim 1, further comprising:

rendering on the display a graphical indication of the results of a comparison of the ITP request and the ATC clearance; and rendering on the display a graphical representation of the transmission status.

3. The method of claim 1, further comprising rendering a graphical representation of the armed status of the datalink report on the display.

4. The method of claim 1, further comprising rendering and textually displaying arming and disarming buttons on the display.

5. The method of claim 1, further comprising:

informing the pilot that there is a match between the ITP request sent and the ATC clearance;

rendering symbology graphically representative of accept, reject and standby buttons on the display;

transmitting a chosen response to ATC; and rendering on the display a graphical representation of the transmission status of the chosen response.

6. The method of claim 3 further comprising rendering and displaying a cue on the ITP display when the ATC clearance has been accepted to prompt the pilot to perform an ITP maneuver.

7. The method of claim 3 further comprising transmitting a message via datalink to ATC when altitude criteria is satisfied if such report has been armed by the pilot.

8. The method of claim 1, further comprising:

informing the pilot that there is a mismatch between the ITP request sent and the ATC clearance received; and identifying the differences on the display.

9. The method of claim 8 further comprising rendering symbology graphically representative of reject and standby buttons on the display.

10. The method of claim 9 further comprising:

selecting one of the reject and standby buttons;

transmitting the selection to ATC; and rendering on the display a graphical representation of the transmission status of the chosen response.

11. A flight deck display system for a host aircraft, the display system for generating symbology associated with an in-trail procedure (ITP) request including communications received from air traffic control (ATC), the display system comprising:

a data communications module for receiving flight status data from neighboring aircraft;

an ITP display element;

an air/ground datalink;

a user interface coupled to the ITP display;

a graphics system; and a processor coupled to the data communications module, the ITP display element, the graphics system, the user interface, and the air/ground datalink, the processor configured to (1) render on the ITP display element a vertical traffic scenario, (2) render on the ITP display element a graphical and textual representation of the ITP request from the host aircraft;

(3) transmit, via an air/ground datalink subsystem (216), the ITP request to ATC for approval of an ITP maneuver, (4) receive from ATC, via the air/ground datalink subsystem (216), and display (i) a first transmission status and (ii) an ATC clearance containing the ITP request, (5) render on the ITP display element the ATC clearance, (6) compare the ITP request with the ATC clearance to determine if they match, and (7) display a graphical representation of options for arming a datalink report associated with the ATC clearance when the ITP request matches the ATC clearance.

12. The system of claim 11 wherein the ITP display includes a vertical situation traffic display region and an adjacent region for graphically and textually displaying communications between the host aircraft and ATC.

13. The system of claim 12 wherein the processor is further configured to highlight any mismatches between the ITP request and the ATC clearance on the ITP display.

14. The system of claim 13 wherein the adjacent region includes a first region primarily dedicated to text generated on the aircraft and a second region primarily dedicated to text generated by ATC.

* * * * *